United States Patent [19]

Schapiro et al.

[11] 4,039,319

[45] Aug. 2, 1977

[54] METHOD OF CALCINING GREEN COKE AGGLOMERATES

[75] Inventors: Norman Schapiro, Sudbury Township, Middlesex County, Mass.; Ronald W. Shoenberger, Monroeville Borough, Pa.

[73] Assignee: United States Steel Corporation, Pittsburgh, Pa.

[21] Appl. No.: 610,210

[22] Filed: Sept. 4, 1975

[51] Int. Cl.[2] ..... C21B 5/00

[52] U.S. Cl. ..... 75/42; 44/10 C; 44/10 K; 264/29.3

[58] Field of Search ..... 75/42; 44/10 R, 10 C, 44/10 K; 201/6, 20; 264/29

[56] References Cited

U.S. PATENT DOCUMENTS

| | | | |
|---|---|---|---|
| 3,441,480 | 4/1969 | Ban | 44/10 R |
| 3,560,346 | 2/1971 | Gunter | 201/20 |

*Primary Examiner*—M. J. Andrews
*Attorney, Agent, or Firm*—W. Gary Goodson

[57] ABSTRACT

An improved process for carbonization of agglomerates to produce formcoke suitable for use in ore reduction furnaces, wherein green formcoke agglomerates are mixed with separator particles of sufficient size and quantity to allow heating gases to pass through the mixture and to prevent the green agglomerates from sticking together while maintaining the mixture as a stationary bed, maintaining the mixture as a stationary bed while passing heating gases through the bed to set the green agglomerates to enable the shape to be maintained in subsequent handling during carbonization and then carbonizing the set agglomerates by heating to a temperature between about 1200° F and about 2300° F. Formcoke of very good strength is produced from pellets formed by tumbling a low density char having a particle size of less than about 100 mesh and a hydrocarbon binder.

27 Claims, 1 Drawing Figure

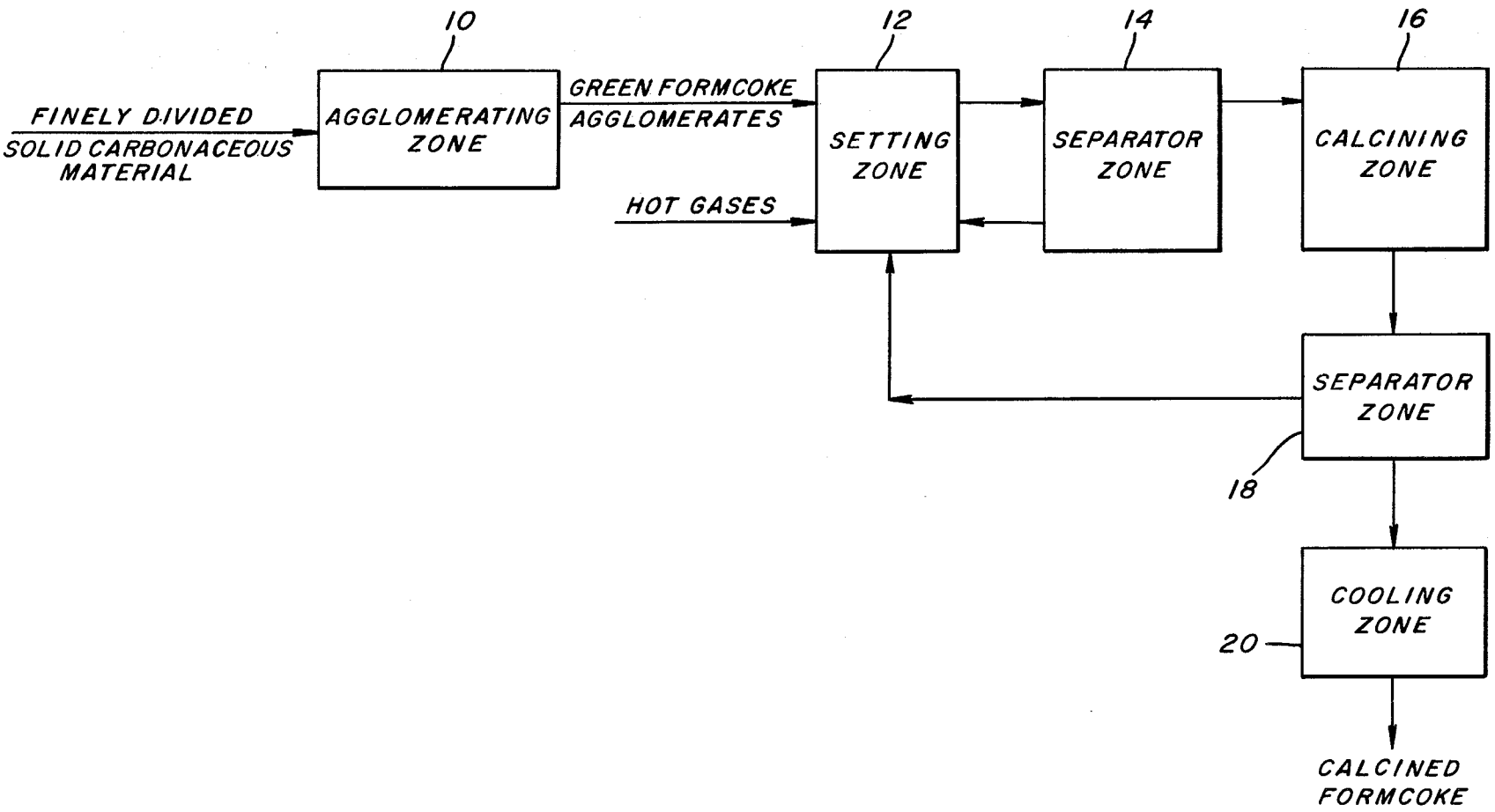
FINELY DIVIDED SOLID CARBONACEOUS MATERIAL
10
AGGLOMERATING ZONE
GREEN FORMCOKE AGGLOMERATES
HOT GASES
12
SETTING ZONE
14
SEPARATOR ZONE
16
CALCINING ZONE
SEPARATOR ZONE
18
COOLING ZONE
20
CALCINED FORMCOKE

METHOD OF CALCINING GREEN COKE AGGLOMERATES

BACKGROUND OF THE INVENTION

1. Field of the Invention

This invention relates to a process for producing form-coke suitable for use in blast furnaces and other ore reduction furnaces, and more particularly, to an improved method of carbonizing green formcoke agglomerates.

2. Description of the Prior Art

Many processes are known for making agglomerates from carbonaceous solids and binders of different kinds. Briquetting presses, rotary retorts, balling drums and other equipment have been employed in these processes. The agglomerates so produced are then heated (calcined) to carbonize the agglomerates and make coke suitable for use in metallurgical operations. The term "formcoke" is used herein to describe agglomerates in the carbonized state. The term "green coke agglomerate" is used to designate the freshly formed agglomerate before heat is applied in the carbonization step or in a preliminary setting step to harden the agglomerate prior to the carbonization step.

The strength of the formcoke must be sufficient to sustain the "burden" of the ore reduction furnace. For use in the blast furnace, the strength of the formcoke should be very high to minimize formation of fine particles which decrease furnace burden permeability. Calcining of the agglomerates plays a critical role in producing formcoke of the required strength. However, one problem which has arisen with certain types of green coke agglomerates is they tend to be very delicate and any type of shearing forces whatsoever during any application of heat tends to cause deterioration of the agglomerate such as crumbling, loss of shape of the agglomerate and the like. Attempts to overcome this problem have utilized a setting step wherein the green coke agglomerate was heated for a time and temperature sufficient to prevent the deterioration of the agglomerate in the subsequent handling during carbonization. However, in order to prevent the pellets from sticking together during this heating step it was necessary to maintain very shallow beds such as two or three pellets (3 or 4) inches in depth and to heat for long periods of time such as three to five hours or longer.

Accordingly, an object of the present invention is to provide a method whereby green coke agglomerates can be calcined without significant deterioration and to increase the throughput of agglomerates in the setting step and to decrease the time in this step.

SUMMARY OF THE INVENTION

A process for producing formcoke suitable for use in an ore reduction furnace comprises (1) agglomerating discreet solid carbonaceous particles to form green coke agglomerates (2) setting the green agglomerates to enable the shape to be maintained during subsequent handling during carbonization (3) carbonizing the set agglomerates by heating, the improvement being that the setting step is accomplished by (1) forming a mixture of the green coke agglomerates and separator particles, such separator particles having a minimum particle size of about ⅛ inch, and having a size and being present in sufficient quantities to allow heating gases to pass through the mixture and to prevent the green agglomerates from sticking together while maintaining the mixture as a stationary bed, and (2) maintaining the mixture as a stationary bed during the setting step while passing heating gases through the bed.

Formcoke of very good strength for use as a metallurgical grade coke is produced from pellets formed by tumbling at substantially atmospheric pressure a low density porous char which has been ground to a particle size of less than 100 mesh in combination with a liquid hydrocarbon binder.

BRIEF DESCRIPTION OF THE DRAWING

The FIGURE is a schematic illustration of the process of this invention.

DESCRIPTION OF THE FIGURE AND PREFERRED EMBODIMENTS

Referring to the FIGURE, numeral 10 designates an Agglomerating Zone where a carbonaceous feed is formed into green coke agglomerates. By a preferred method a finely divided solid carbonaceous material is mixed with a liquid hydrocarbon material in the tumbling zone of a rotating vessel. Preferably the solid carbonaceous material has a maximum particle size of about ¼ inch and the liquid hydrocarbon material is present in amounts of between about 10 to about 60 percent by weight of the total material. The green coke agglomerate has a size in the range of about ⅝ inch to 3 inches. Preferably the agglomerating step is carried out at substantially atmospheric conditions, preferably at a temperature between 150° F and 750° F. The green coke agglomerates are conducted to the first heating zone 12 designated as the Setting Zone where the agglomerates are mixed with separator particles to form a stationary bed. The separator particles have a minimum size of about ⅛ inch. The size and quantity present in the stationary bed is such as to prevent the agglomerates from sticking during the setting step while allowing heating gases to pass through the mixture and at the same time maintaining the mixture as a stationary bed. If the separator particles get below about ⅛ inch they tend to block the passage of the gases through the mixture which tends to cause a pressure buildup of the gases and disruption of the bed and resultant deterioration of the green coke agglomerate. The agglomerates in the setting zone are heated to a temperature between about 212° and about 1000° F and preferably for a time period between about 1½ and about 3 hours. The term stationary bed refers to the fact that there is substantially no movement of the green coke agglomerates with respect to adjacent green coke agglomerates. However, a preferred setting zone is a moving grate whereby the heating gases are passed up through the grate and the stationary bed may be a much thicker bed than was possible in the prior method. Beds of 15 or 20 inches in depth or greater are now possible by the invention. After completion of the setting step the set green coke agglomerates are passed into Separator Zone 14 which is an optional zone for separating out the separator particles. Preferably, these separator particles are of the different size than the green coke agglomerates and therefore can be readily screened out and returned to the Setting Zone 12 for further use. The separator particles are preferably carbon particles such as coke pellets or coal char or the like. Obviously if a formcoke of the desired properties were utilized it would not be necessary to separate these from the set green coke agglomerates. Additionally, even when separation is desired it can be postponed until a later time such as in Separator Zone 18. However, generally, it is preferred to separate these particles out prior to entering the Calcining Zone 16 in order to increase the throughput of agglomerates through the Calcining Zone 16. The Setting Zone 12 may be conducted in an inert atmosphere or in an oxidizing atmosphere. In an inert atmosphere, the setting temperature is generally greater than about 900° F. In an oxidizing atmosphere containing 6 or 7 percent oxygen or greater, a temperature below about 500° F is used generally desirable. Above about 500° F in such an oxidizing atmosphere problems of combustion will occur in the bed and possibly various particles being fused together during the setting step can arise. Obviously by using an inert atmosphere in the setting zone with an amount of oxygen less than about 6–7 percent temperature above 500° F may be suitable.

The set green coke agglomerates which have passed from the Setting Zone 12 into the Calcining Zone 16 are carbonized at temperatures suitable to produce a solid agglomerated fuel product suitable for use in an ore reduction furnace. Temperatures between about 1200° F and about 2300° F are generally preferred. Temperatures between about 1700° F and about 1950° F are most preferred.

The preferred method of forming green coke agglomerates is by mixing discrete solid carbonaceous particles with a liquid hydrocarbon material in a tumbling zone of a rotating vessel to produce unset agglomerates having a particle size within the range of about $\frac{5}{8}$ inch to 3 inches. A tumbling zone of the rotating vessel includes any of the standard equipment such as pelletization equipment, balling drum, rotating drum and other such equipment that is readily performed at substantially atmospheric pressure. The process of this invention is especially designed for very delicate green coke agglomerate which upon heating with any significant movement between particles will cause deterioration of the agglomerate.

The carbonaceus material of this invention may include any of the common art recognized starting materials for forming formcoke such as coal of various types, petroleum char or coke, coal char, crushed coke or crushed formcoke or the like. The preferred carbonaceous material for use in the preferred tumbling method of making agglomerates described above is a coal char and especially a low density coal char such as is produced by low temperature carbonization below a temperature of about 1400° F. Such low density char often contains large cenospheres and an open structure such that a weak formcoke is obtained. However, it has been found that with this low density char containing such open structure, the strength of the formcoke is increased markedly when the char has been pulverized to a particle size below about 100 mesh and preferably below about 200 mesh.

A preferred process of making the preferred coal char is in a fluidized bed carbonization process in which coal material is crushed to less than about $\frac{1}{8}$ inch particle size and is carbonized at a temperature below about 1400° F. Preferably, the coal is also desulfurized during the carbonization process in a hydrogen containing atmosphere at a temperature of between about 800° F and about 1400° F and at a pressure between about atmospheric and about 300 psia. Such a process is more fully disclosed in copending U.S. patent application Ser. No. 501,898 filed Aug. 30, 1974 in the names of M. C. Field et al., incorporated herein by reference.

The hydrocarbon materials of this invention will be liquid at a temperature in which the green coke agglomerate is produced in the agglomerating step. It is preferred that the hydrocarbon material have the viscosity of 10 poise or lower at a temperature below about 750° F and preferably between about 150° to 750° F. The hydrocarbon materials include such things as middle boiling oil, heavy oil, road tar, pitch and asphalt. The middle oil is generally boiled in the range of 950° to 750° F, the heavy oils have a boiling point greater than 750° F. These hydrocarbon materials are also exemplified by such things as petroleum asphalts, high temperature coal tar pitches, fluxed coal digested pitch and fluxed coal extract. These hydrocarbon materials may be derived from a number of liquid processes such as petroleum and coke oven gas distillation processes and coal liquefaction processes. Normally, they are obtained as the residues after the lighter boiling products from these varied processes have been removed.

The hydrocarbon materials of this invention may have the following typical properties: softening point, degrees C (Ring and Ball) 25–150; Conradson Coke Value, weight percent, 18–60; Quinoline Insoluble, weight percent, 4–12; benzene insoluble, weight percent, 10–20; carbon to hydrogen ratio, 1.0–2.0.

The hydrocarbon material suitable for use in this invention may be blended with each other to form a composite material or they may be treated by art recognized techniques to improve the flow and the ability of the hot carbon to yield a strong resultant coke. In addition, modifiers for the hydrocarbon material may include, for example, low viscosity diluents such as light hydrocarbon oil, kerosene or low temperature coal tar added to the hydrocarbon material as a flux to improve its flow characteristics.

The finely divided carbonaceous material and the hydrocarbon material are mixed together in such proportions that the hydrocarbon material will be from about 10 to about 60 percent of the final mixture. It is especially desirable to have the hydrocarbon material about 24 to 38 percent of the mixture. When the finely divided carbonaceous material is predominantly of very fine sizes such as below about 100 mesh, the proportion of hydrocarbon material tends to increase. For example, when finely divided carbonaceous material has a size less than about 28 mesh, then it may be desirable to have 27 to 28 percent of the overall mixture as hydrocarbon material. On the other hand, when the carbonaceous material has a size less than about 100 mesh, a hydrocarbon percentage of from about 32 to 38 percent is desirable. When the particle size is below about 200 mesh, the proportion of hydrocarbon material tends to increase to about 38 percent or more of the total weight of the materials. The particular proportions of one ingredient with respect to the other ingredients depends upon the agglomerating characteristics of the mixture, the temperature at which the process is conducted, as well as the final properties desired in the formcoke. As stated above, the process of the invention is especially designed to produce formcoke pellets which will make good blast furnace coke. Thus, the formcoke product of this invention is combined with a metallic ore and heated to yield a metal. Preferably the metallic ore is iron ore. This ore may be in the form of raw ore, cinter, pellets or the like. For use as a metallurgical coke, it has been found that the tumbler hardness factor of greater than about 70 (at 1400 revolutions) is especially desired. In order to achieve the desired formcoke properties, it has been found particularly important to use sufficient quantities of binder to wet the solid particles and to obtain an essentially homogeneous mixture of char and binder in order to obtain maximum strength in the formcoke.

The separator particles are preferably separated from the set green coke agglomerate immediately after the setting step. However, as pointed out previously, it is possible to conduct it later on such as immediately subsequent to the carbonizing step. The separated separator particles may then be recycled to mix with green coke agglomerates and used in the setting step.

The preferred side range of the formcoke depends upon the size of ore material that is to be reduced by the fuel in a blast furnace. Pelletized iron ore material may use pellets of ¾ inch to 1¼ inches sizes. Crude iron ore material may use pellets of ¾ inch to 3 inches sizes. Overall, pellets of about ⅝ inch to 3 inches sizes will be suitable as part of the burden in most ore reduction processes.

At the high temperatures and gas compositions encountered with blast furnaces, the solid fuel material of the invention retains its shape and remains strong. In addition, the fuel material exhibits surface oxidation over the area of its pellets when heated to high temperatures (3000° F). Moreover, premature loss of hydrocarbon material from the pellet during oxidation is avoided. Thus, the solid fuel material has properties equivalent to high grade metallurgical coke.

As has been the practice with cokes, the kind of ore reduction and the size of the blast furnace determine the minimum strength of solid fuel material which will be required for the particular ore reduction. In large furnaces with very heavy burdens, the strongest fuel material will be necessary. When reducing such things as a phosphorous ore, a weaker solid fuel material than that used for iron ore is suitable. Composites may be made by blending stronger fuel material and weaker fuel material, optionally with other cokes of varying strengths, which composites may be used in the ore reduction process.

EXAMPLE 1

A coke is crushed and sized to 100 percent −28 mesh with the following size distribution:

| Screen Size | Cum. Percent Retained |
|---|---|
| 30 - Mesh | 0.3 |
| 50 - Mesh | 16.8 |
| 100 - Mesh | 43.7 |
| 200 - Mesh | 72.7 |

This material has a volatile matter content of 6 percent and is heated to 322° F and placed as a layer in a pan pelletizer. Road tar is heated to about 360° F and added to the pan to make up about 29 percent of the mixture. This road tar has the following specification:

| | |
|---|---|
| Softening point ° C (Ring & Ball) | 40 |
| Conradson Coke Value, weight percent | 50 |
| Quinoline Insoluble, weight percent | 9 |
| Benzene Insoluble, weight percent | 16 |
| C/H ratio | 1.6 |

Additional solids and tar are added continuously to the pan. These materials are mixed together until pellets having diameters in the range of about ¾ inch to 1¼ inches were obtained. These pellets underwent a setting step by heating in a curing oven at a pellet depth of about 3 inches to 500° F at a rate of 100° F rise per hour for about 3½ hours. No separator particles were utilized. Afterwards, these pellets are carbonized at a flue temperature of about 2000° F and are removed from the oven when they have a center temperature of 1760° F. The samples are then tested for abrasion resistance by ball mixing; the abrasion index of material retained on ¼ inch screens may be 96½. They also may have a breaking strength of 800 lbs. and an apparent specific gravity of 0.97.

When the above example was repeated except with a setting step wherein the pellet depth was greater than about 3 inches resulted in serious problems of the pellets fusing to one another during the heating. Agitation of the pellets during the setting step resulted in crumbling of the pellets and/or deformed pellets.

EXAMPLE 2

The effect of grinding the char to finer sizes is shown in Table 1 below. As noted, the strength of the formcoke produced according to the process of this invention is increased as the char was pulverized more finely.

Low density coal char containing large cenospheres and a porous structure having a particle size of less than about ⅛ inch is combined with liquid coal tar pitch at a temperature of 360° F in a disc pelletizer operated at a pitch of 41° and at a speed of 30 rpm to produce pellets having a particle size of from about ¾ inch to about 1¼ inches. The coal char is present in an amount of 73 percent by weight and the pitch in an amount of 27 percent based on the weight of total materials. The coal char by carbonizing fine coal particles in a fluid bed at 1140° F at close to atmospheric pressure.

The green pellets thus produced are then placed in a shallow bed about 2 to 3 pellets in depth and set by blowing hot air up through the bed starting at 150° F and increasing gradually at a rate of 100° F per hour for about 3½ hours until a temperature of 500° F is reached. No separator particles were utilized. Afterwards the set green pellets are calcined at 1800° F for 2½ hours to carbonize.

As can be seen from Table 1, a weak formcoke is obtained which is not suitable as a metallurgical coke substitute in many processes when the particle size is less than about 65 mesh. However, when these char particles are crushed to eliminate the cenospheres and puffy structure, i.e. a maximum char particle size of 100 mesh, the formcoke produced has significantly improved properties and is suitable as a metallurgical coke substitute in most processes.

Table 1

Effect of Char Size on Strength of Resultant Coke Pellet*

| Char Pulverized to 98–100% minus | ⅛ inch | 28-mesh | 65-mesh | 100-mesh |
|---|---|---|---|---|
| Crushing Strength, lbs (whole pellet) | 590 | 700 | 630 | 820 |
| Tumbler Strength (1400 rev) Plus ¼ inch Index | 53 | 59 | 64 | 74 |
| Apparent Specific Gravity | 0.94 | 0.97 | 0.88 | 1.10 |

*Pellets made from Illinois No. 6 seam char and coal-tar pitch. Carbonized in pilot test coke oven to 1800 F.

Similar results are obtained when Example 2 is repeated except that the setting step is performed as described in Example 3 utilizing separator particles.

Example 3

The following ingredients are combined in a pelletizer which is operating at a 38° angle and a speed of 30 rpm: 60 percent by weight coal char — 98 percent of the particles having a particle size less than 100 mesh — 8 percent by weight fluid petroleum coke — 98 percent of the particles having a particle size of less than 100 mesh — 32 percent of a liquid coal tar pitch binder (RT 12) at 355° F. These materials are mixed together until pellets having diameters in the range of about ¾ inch to 1¼ inches are obtained. These pellets are then carefully mixed with conventional coke pellets having a particle size between ½ inch and ¼ inch and placed in a vertical retort operated on a batchwise basis such that no substantial movement of the bed occurs during a two-hour heating period wherein the temperature is maintained at about 830° F while nitrogen heating gases are allowed to pass up through the mixture of green coke agglomerates and conventional coke pellets. A stationary pellet bed is maintained during this two hour heating period to set the pellets. The ½ inch × ¼ inch coke pellets are then separated from the set green coke agglomerates by a screening technique and the set green coke agglomerates are passed into a continuous vertical retort heated to a temperature of 1800° F by nitrogen heating gas stream. The heating at this temperature continues for a period of about 3½ hours after which time the formcoke is cooled and used as a metallurgical coke for reducing iron ore in a blast furnace. The formcoke thus produced has a crushing strength of 950 pounds (whole pellet) and an apparent specific gravity of 1.10. No significant crumbling or other deterioration of the set green coke agglomerate is observed to take place during or after the heating at 1800° in the continuous vertical retort.

Example 4

A coal char having 98 percent of the particles having a particle size less than 100 mesh is added with a liquid digested coal pitch at 370° F and a disc pelletizer operated at a 38° pitch at a speed of 30 rpm. The coal char is present in an amount of 32 percent by weight. The pellets formed have diameters in the range of about ¾ inch to 1¼ inch. These pellets are then carefully mixed with conventional metallurgical coke having a particle size between ¼ inch and ½ inch and placed in a shaft retort which is operated on a batch basis such that an essentially stationary bed of green coke agglomerates and conventional coke is maintained at a temperature of about 950° F for 1¾ hours by means of a nitrogen heating gas flowing up through the bed.

The conventional coke pellets are then separated from the said green coke agglomerates by screening and these coke agglomerates are heated to a temperature of 1800° F for a period of 3⅓ hours to accomplish final carbonization of the agglomerates. The agglomerates are then cooled to leave a formcoke pellet having a crushing strength of 670 pounds.

Example 5

A coal char present in the amount of 71 percent by weight and having a particle size of less than about 65 mesh is combined with a liquid pitch present in an amount of 29 percent by weight and having a temperature of 355° F. The materials are combined in a disc pelletizer operated at a pitch of 42° and at a speed of 30 rpm. The pellets produced have diameters in the range of about ¾ inch to 1¼ inch. These green coke agglomerates are then carefully mixed with conventional coke particles having a particle size of ¼ inch × ½ inch to produce a stationary bed of agglomerates and pellets having a depth of 8 inches. Heating gases having 5–7 percent oxygen is passed up through the stationary bed to achieve a temperature of 550° F for a time period of 1.5 hours. The coke pellets having a size of ¼ inch to ½ inch are then screened from the set green coke agglomerates. These agglomerates are then carbonized for heating to a temperature of 1800° F for a time period of 2½ hours. The cooled formcoke thus produced gives a good lustrous appearance, being smooth and showing no substantial cracks. The crushing strengh of these formcoke pellets is 530 pounds.

We claim:

1. In a process of producing a solid agglomerated fuel product suitable for use in an ore reduction furnace comprising (1) agglomerating discrete solid carbonaceous particles to form green coke agglomerates; (2) setting said green agglomerates to enable the shape to be maintained in subsequent handling during carbonization; (3) carbonizing the set agglomerates by heating, the improvement wherein the setting step is accomplished by (1) forming a substantially uniformly mixed stationary bed of the green coke agglomerates and separator particles such separator particles having a minimum particle size of about ⅛ inch and having a size and being present in sufficient quantities to allow heating gases to pass through the mixture and to prevent the green agglomerates from sticking together while maintaining the mixture as a stationary bed; and (2) maintaining the mixture as a stationary bed during the setting step while passing heating gases through the bed.

2. Process as in claim 1 wherein said carbonaceous material consists essentially of char from coal which has been carbonized at a temperature below about 1400° F and wherein the agglomerating step is carried out at substantially atmospheric conditions.

3. Process of reducing a metal ore comprising combining the carbonized fuel product of claim 1 with a metallic ore and heating the same to yield a metal.

4. Process as in claim 3 wherein the metallic ore is iron ore.

5. In a process of producing a solid agglomerated fuel product comprising (1) agglomerating discrete solid carbonaceous particles in a tumbling zone of a rotating vessel by mixing a solid carbonaceous material having a maximum particle size of about ¼ inch and a liquid hydrocarbon material as a binder to produce a delicate, green, unset agglomerate having a particle size within the range of about ⅝ inch to about 3 inches, said hydrocarbon material being about 10 to about 60 percent by weight of the total materials; (2) setting said green agglomerates to enable the shape to be maintained in subsequent handling during carbonization; (3) carbonizing the set agglomerates by heating at a temperature between about 1200 and about 2300° F, the improvement wherein the setting up is accomplished by (1) forming a mixture of the green agglomerates and separator particles, such separator particles having a minimum particle size of about ⅛ inch and having a size and being present in sufficient quantities to allow heating gases to pass through the mixture and to prevent the green agglomerates from sticking together throughout the depth of a stationary bed; and (2) maintaining the mixture as a stationary bed during the setting step while passing heating gases through the bed.

6. Process as in claim 5 wherein said carbonaceous material consists essentially of char from coal which has been carbonized at a temperature below about 1400° F and wherein the agglomerating step is carried out at substantially atmospheric conditions.

7. Process as in claim 6 wherein said separator particles are carbon particles.

8. Process as in claim 7 wherein said carbon particles are coke particles of a size which can readily be screened out from the set agglomerates.

9. Process as in claim 5 wherein the agglomerating step is carried out at a temperature between 150° F and 750° F and said setting is performed by heating said agglomerate at a temperature in the range of about 212 to 1000° F.

10. Process as in claim 5 wherein said setting is performed by heating said agglomerate at a temperature in the range of about 500° to 900° F.

11. Process as in claim 5 wherein said agglomerating takes place in pelletization equipment.

12. Process as in claim 5 wherein said agglomerating takes place in balling drum equipment.

13. Process as in claim 5 wherein said carbonaceous material consists essentially of char having a sulfur content less than 1% and an ash content less than 8.5%.

14. Process as in claim 13 wherein said char is from a fluidized bed carbonization process in which coal material crushed to less than about ⅛ inch size is carbonized and desulfurized in a hydrogen containing atmosphere at a temperature of about 800° to 1400° F and at a pressure about atmospheric and up to 300 psia.

15. Process as in claim 13 wherein said char has a size of less than about 100 mesh.

16. Process as in claim 14 wherein said char has a size of less than about 200 mesh.

17. Process as in claim 5 wherein said setting is conducted by heating to a temperature between about 212° F and about 1000° F for a time period between about 1½ and about 3 hours.

18. Process as in claim 5 wherein said solid fuel product is suitable for substitution for high grade metallurgical coke and has a high abrasion resistance as indicated by a tumbler hardness factor of at least 74 at 1400 revolutions and has a sulfur content less than 0.6%.

19. A process of producing a solid agglomerated fuel product suitable for substitution for high grade metallurgical coke comprising:

a. Agglomerating by mixing together in tumbling zone of a rotating vessel under substantially atmospheric pressure a finely divided solid carbonaceous material having a maximum particle size of about ¼ inch and a liquid hydrocarbon material at a temperature sufficient to form green, unset homogeneous agglomerates having a normal size distribution within the range of about ⅝ inch to 3 inches and wherein said hydrocarbon material has a minimum normal boiling point about 250° F and a viscosity of 10 poise or less at temperatures up to 750° F, said hydrocarbon material being about 10 to 60 percent by weight of the total materials;

b. Mixing said green agglomerates with separator particles having a particle size between about ⅛ inch to about ¾ inch to form a substantially uniformly mixed stationary bed of said agglomerates and separator particles;

c. Setting the mixture of green coke agglomerates and separator particles in a stationary bed to enable the shape of said agglomerate to be maintained during subsequent handling for carbonization by heating said agglomerates at a temperature in the range of about 212° to about 1000° F by passing hot gases through the mixture; and then d. Carbonizing said agglomerates by heating at a temperature of between about 1200° and about 2300° F.

20. Process as in claim 19 wherein said separator particles are carbon particles.

21. Process as in claim 20 wherein said agglomerating is carried out in pelletization equipment.

22. Process as in claim 20 wherein said finely divided carbonaceous material consists essentially of char.

23. Process as in claim 22 wherein said char has a size less than about 100 mesh.

24. Process as in claim 22 wherein said char is produced by carbonizing coal and wherein said stationary bed has a depth of from about 15 to about 20 inches.

25. Process as in claim 19 comprising the additional step subsequent to the setting step of separating the separator particles from the set coke agglomerates and recycling these separator particles and mixing with green coke agglomerates and using in the setting of step (c).

26. A process for producing a solid agglomerated fuel product suitable for substitution for high grade metallurgical coke comprising:

a. Agglomerating by mixing together in a tumbling zone of a rotating vessel under substantially atmospheric pressure a finely divided solid carbonaceous material consisting essentially of low density coal char having a maximum particle size of about 100 mesh and a liquid hydrocarbon material at a temperature sufficient to form green, unset homogeneous coke agglomerates having a normal size distribution within the range of about ⅝ inch to 3 inches and wherein said hydrocarbon material has a minimum normal boiling point about 250° F and a viscosity of 10 poise or less at temperatures up to 750° F, said hydrocarbon material being about 10 to 60 percent by weight of the total materials;

b. Forming a substantially uniformly mixed bed of green coke agglomerates with separator particles of sufficient size and present in sufficient quantities to prevent fusing of adjacent agglomerates while allowing heating gases to pass through the mixture while maintaining the mixture as a stationary bed during the setting step;

c. Setting the mixture of green coke agglomerates and separator particles in a stationary bed to enable the shape of said agglomerate to be maintained during subsequent handling for carbonization by heating said agglomerates at a temperature in the range of about 212° to about 1000° F; and then d. Carbonizing said agglomerate by heating at a temperature of between about 1200° and about 2300° F.

27. Process as in claim 26 wherein said coal char has been carbonized at a temperature below about 1400° C and wherein the char has a maximum particle size of about 200 mesh.

* * * * *